US007651372B2

(12) United States Patent
Matsuzaki et al.

(10) Patent No.: US 7,651,372 B2
(45) Date of Patent: Jan. 26, 2010

(54) ELECTRIC CONNECTOR WITH SHIELDS ON MATING HOUSINGS

(75) Inventors: Shinichi Matsuzaki, Yokohama (JP); Hitoshi Suzuki, Yokohama (JP)

(73) Assignee: IRISO Electronics Co., Ltd., Kanagawa (JP)

( * ) Notice: Subject to any disclaimer, the term of this patent is extended or adjusted under 35 U.S.C. 154(b) by 0 days.

(21) Appl. No.: 12/160,116

(22) PCT Filed: Dec. 20, 2006

(86) PCT No.: PCT/JP2006/325400

§ 371 (c)(1),
(2), (4) Date: Jul. 7, 2008

(87) PCT Pub. No.: WO2008/044324

PCT Pub. Date: Apr. 17, 2008

(65) Prior Publication Data

US 2009/0029592 A1 Jan. 29, 2009

(30) Foreign Application Priority Data

Oct. 5, 2006 (JP) ..... 2006-273953

(51) Int. Cl.
*H01R 13/648* (2006.01)

(52) U.S. Cl. ..... 439/607.01

(58) Field of Classification Search ..... 439/66, 439/65, 607, 83, 79, 607.23, 607.01, 607.53, 439/607.55

See application file for complete search history.

(56) References Cited

FOREIGN PATENT DOCUMENTS

| | | |
|---|---|---|
| JP | 11-026108 | 1/1999 |
| JP | 11-297435 | 10/1999 |
| JP | 2002-246119 | 8/2002 |
| JP | 2002-298983 | 10/2002 |

*Primary Examiner*—Javaid Nasri
(74) *Attorney, Agent, or Firm*—Lowe Hauptman Ham & Berner LLP

(57) ABSTRACT

The present invention provides a connector which can take an EMI measure for the first and second housings and can move the second housing with respect to the first housing. The connector comprises a plug which is provided so as to be movable with respect to the socket; a plurality of socket terminals which are resiliently deformed with a movement of the plug; a first socket side shield member which covers an outer circumference surface in the width direction of the socket; a plurality of plug terminals which are in contact with each of the socket terminals when the plug is mated with the socket; a plug side shield member which covers an outer circumference surface in the width direction of the plug; and first and second shield conductive portions which are in contact with each of the shield members and are resiliently deformed as the plug is moved.

6 Claims, 5 Drawing Sheets

ELECTRIC CONNECTOR WITH SHIELDS ON MATING HOUSINGS

RELATED APPLICATIONS

The present application is based on, and claims priority from, JP Application Number 2006-273953, filed Oct. 5, 2006, and PCT Application No. JP06/325400, filed Dec. 20, 2006, the disclosures of which are hereby incorporated by reference herein in their entireties.

BACKGROUND OF THE INVENTION

1. Field of the Invention

The present invention relates to a connector which is attached to a printed-circuit board or the like and is used to electrically connect a plurality of printed-circuit boards to each other.

2. Description of the Related Art

Conventionally, as such a connector, there has been known a connector provided with a first housing which is provided at one connection object side; a second housing which is provided at the other connection object side and is formed so as to be matable with the first housing; a plurality of first terminals which are held by the first housing; a first shield member which is provided in the first housing and is formed so as to extend in the direction of arrangement of the first terminals; a plurality of second terminals which are held by the second housing and each of which is formed so as to be in contact with each of the first terminals when the second housing is mated with the first housing; and a second shield member which is provided in the second housing and which is formed so as to extend in the direction of arrangement of the second terminals (for example, see Patent Document 1).

This connector provides each of the first and second housings with a shield member to take an electromagnetic interference (EMI) measure for each of the housings.

However, the connector has a problem in that when the second housing is mated with the first housing, the second shield member is formed so as to be engaged in a predetermined position of the first shield member and thus the second housing cannot be moved in a state where the second housing is mated with the first housing and if a positional offset occurs between one connection object and the other connection object, it is difficult to absorb the positional offset.

Patent Document 1: Japanese Patent Publication No. 2002-298983

BRIEF SUMMARY OF THE INVENTION

In view of the above problem, the present invention has been made and an object of the present invention is to provide a connector which can not only take an EMI measure for the first and second housings but also move the second housing with respect to the first housing.

In order to achieve the aforementioned object, the present invention comprising a first housing arranged on the side of one of objects to be connected; a second housing arranged on the side of the other object to be connected, is provided so as to be movable with respect to the first housing and is formed so as to be matable with the first housing; a plurality of first terminals which are held by the first housing and are formed so as to be resiliently deformed with a movement of the second housing; a first shield member which is provided so as to cover a predetermined outer circumference surface of the first housing and is formed so as to extend in the direction of arrangement of the first terminals; a plurality of second terminals which are held by the second housing and each of which is formed so as to be in contact with each of the first terminals when the second housing is mated with the first housing; a second shield member which is provided so as to cover a predetermined outer circumference surface of the second housing and which is formed so as to extend in the direction of arrangement of the second terminals; and a shield conductive portion which is formed so as to be in contact with the first and second shield members when the second housing is mated with the first housing and to be resiliently deformed with a movement of the second housing.

This allows the predetermined outer circumference surface of the first housing to be covered with the first shield member and also allows the predetermined outer circumference surface of the second housing to be covered with the second shield member. Accordingly, it is possible to take an EMI measure. In addition, this also allows the first terminal to be resiliently deformed while being in contact with the second terminal and the shield conductive portion to be resiliently deformed while being in contact with the first and second shield members. Accordingly, a movement of the second housing is permitted.

ADVANTAGES OF THE INVENTION

According to the present invention, the second housing can be moved with respect to the first housing. Thus, if a positional offset occurs between the one connection object and the other connection object, the positional offset can be absorbed. Therefore, it is possible to increase the reliability of connection. In addition, since an EMI measure for the first and second housings can be taken, it is possible to reliably reduce the effect of electromagnetic waves.

DESCRIPTION OF SYMBOLS

Figure 1:
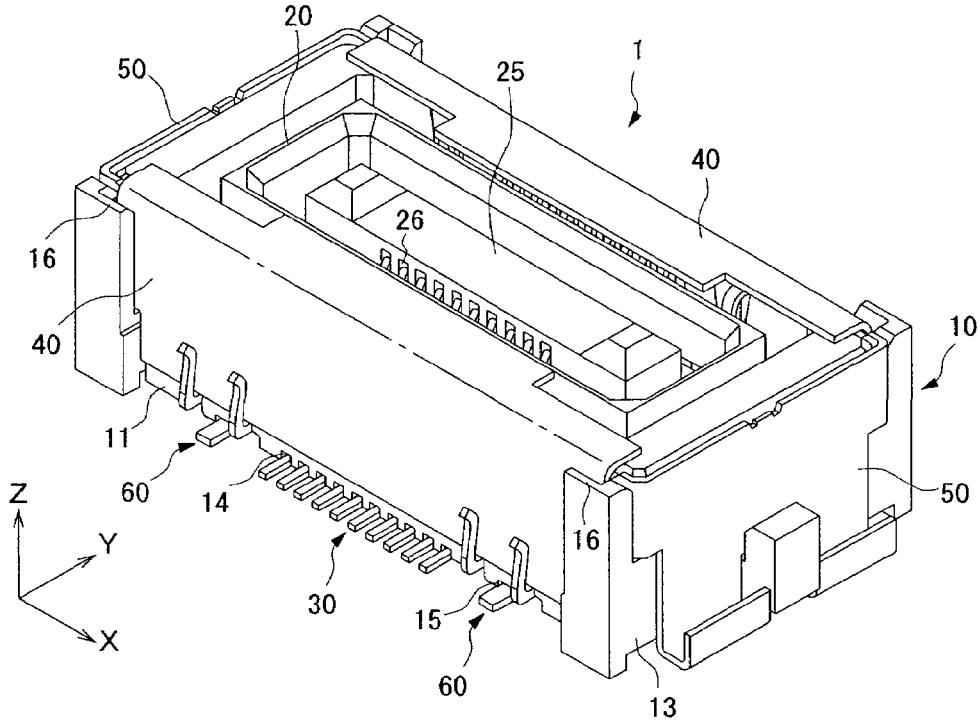
FIG. 1 is a perspective view of a socket in accordance with an embodiment of the present invention.

1 socket
2 plug
30 a plurality of socket terminals
40 a pair of first socket side shield members
60 shield terminal
61 ground connection portion
64 first shield conductive portion
69 second shield conductive portion
80 a plurality of plug terminals
90 plug side shield member
100 first printed-circuit board
200 second printed-circuit board

DETAILED DESCRIPTION OF THE INVENTION

Figure 2:
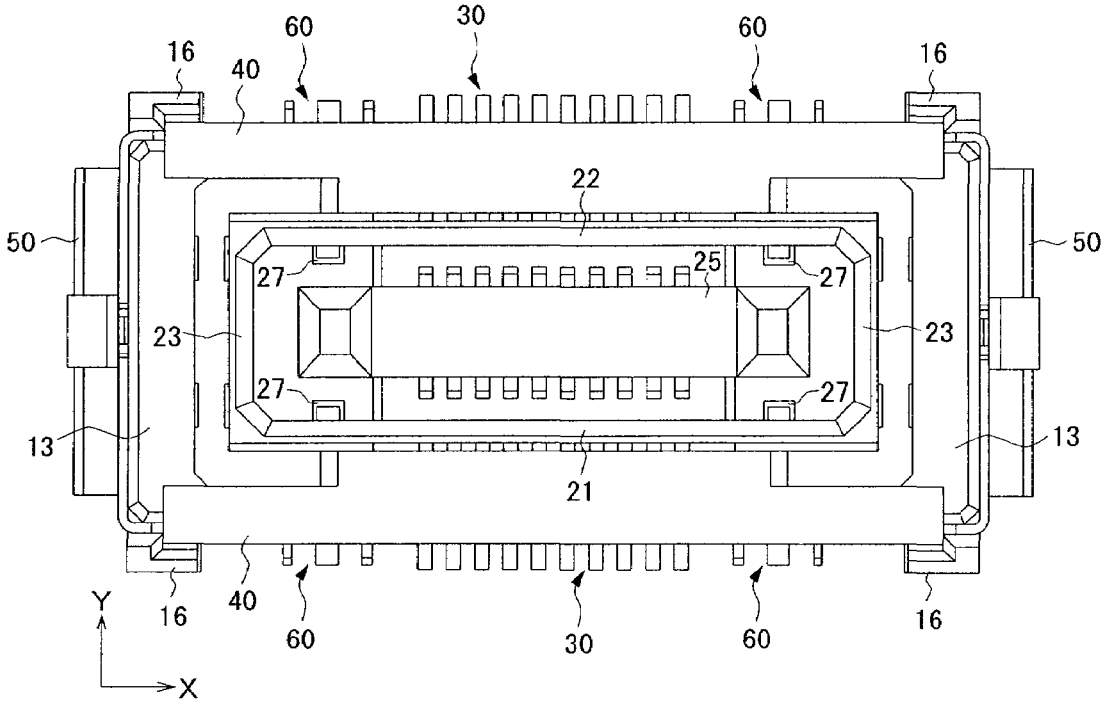
FIG. 2 is a plan view of the socket.
Figure 3:
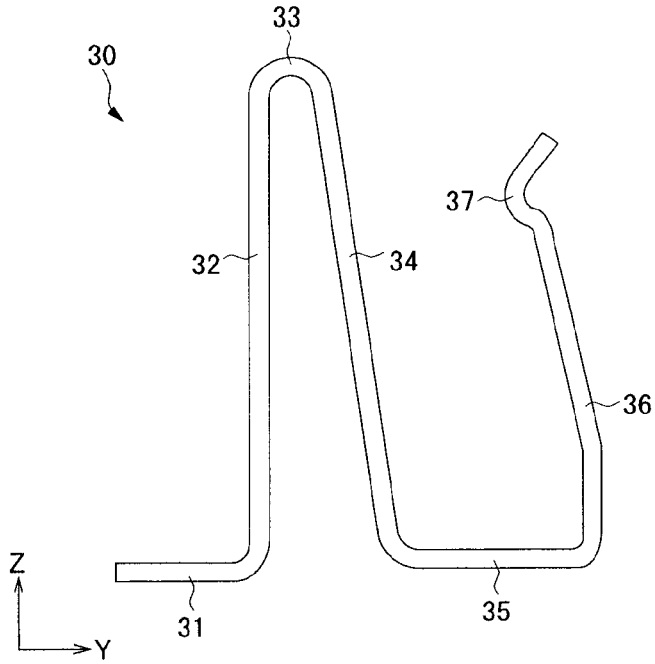
FIG. 3 is a side view of a socket terminal.
Figure 4:
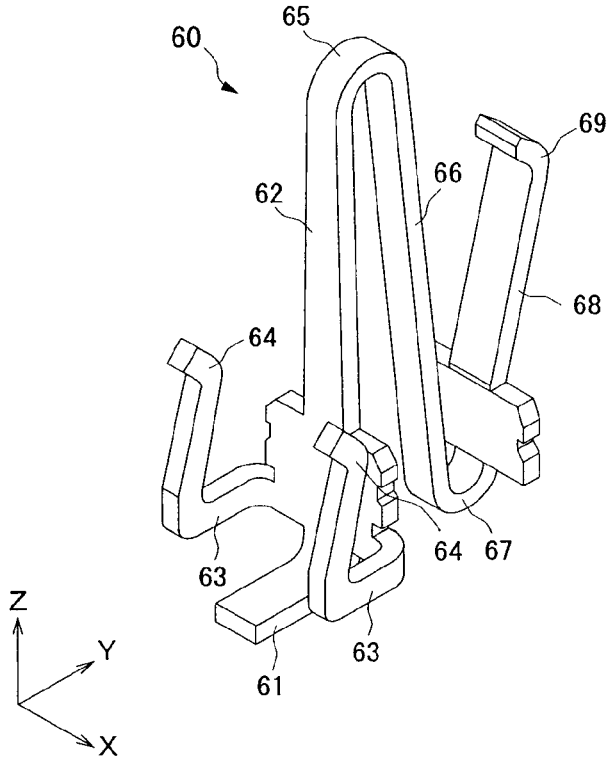
FIG. 4 is a perspective view of a shield terminal.
Figure 5:
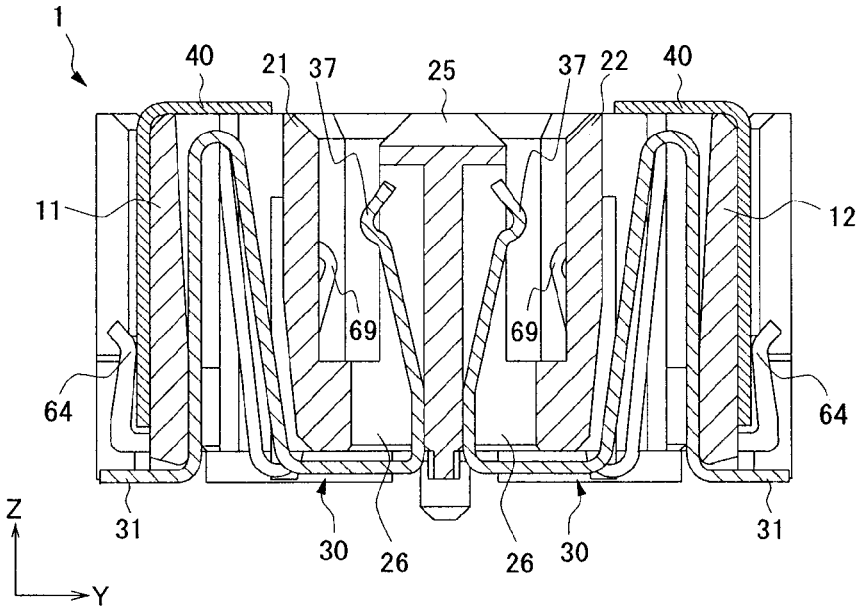
FIG. 5 is a side sectional view of the socket.
Figure 6:
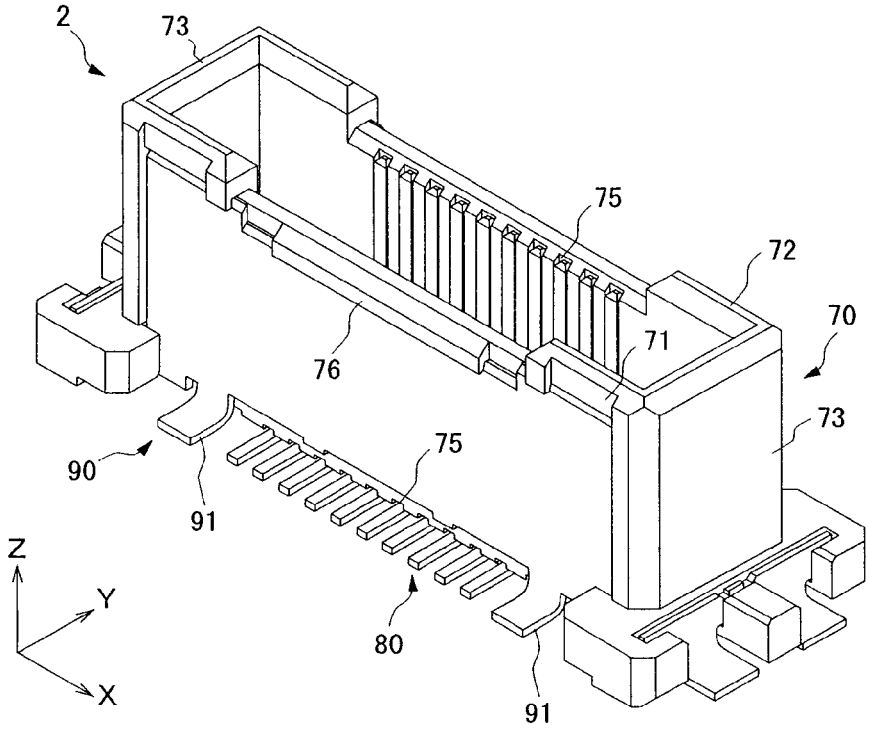
FIG. 6 is a perspective view of a plug in accordance with an embodiment of the present invention.
Figure 7:
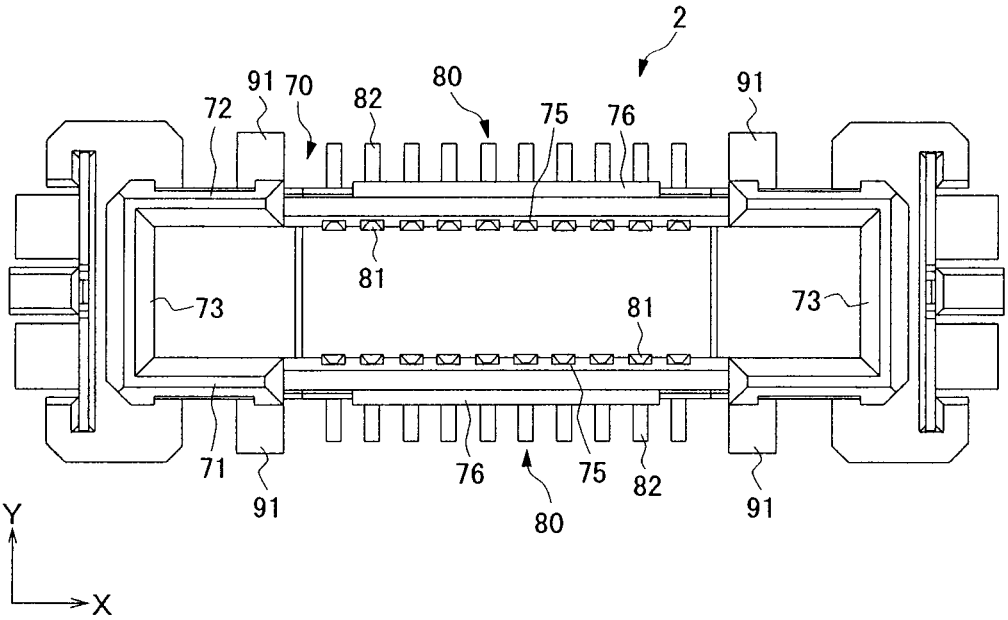
FIG. 7 is a plan view of the plug.
Figure 8:
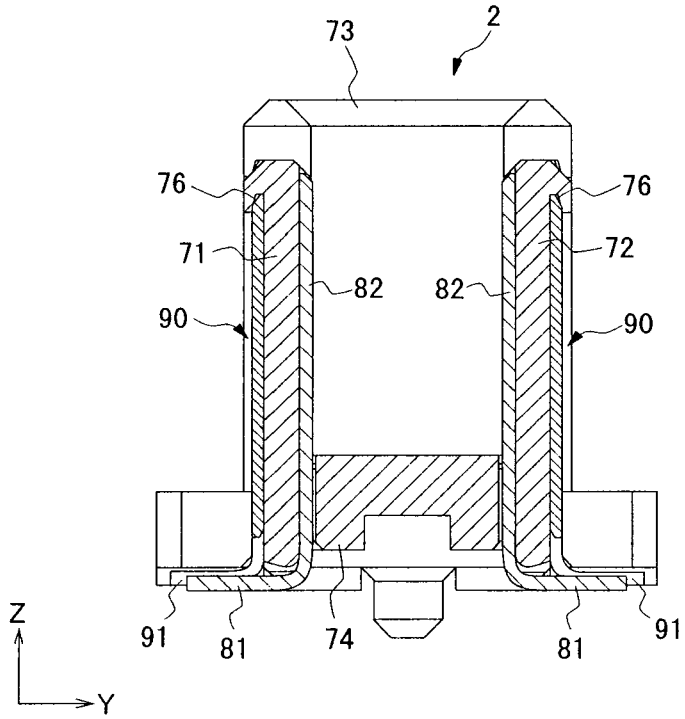
FIG. 8 is a side sectional view of the plug.

FIGS. 1 to 10 show an embodiment of the present invention. More specifically, FIG. 1 is a perspective view of a socket; FIG. 2 is a plan view of the socket; FIG. 3 is a side view of a socket terminal; FIG. 4 is a perspective view of a shield terminal; FIG. 5 is a side sectional view of the socket; FIG. 6 is a perspective view of a plug; FIG. 7 is a plan view of the plug; FIG. 8 is a side sectional view of the plug; and FIGS. 9 and 10 each is a side sectional view of an operation when the socket is mated with the plug.

The connector consists of a socket 1 serving as a first housing arranged on a first printed-circuit board 100 serving as one of objects to be connected; and a plug 2 serving as a second housing arranged on a second printed-circuit board 200 serving as the other object to be connected, is provided so as to be movable with respect to the socket 1, and is formed so as to be matable with the socket 1. The connector is used to electrically connect between the printed-circuit boards 100 and 200.

As shown in FIGS. 1 and 2, the socket 1 is provided with a socket side fixed housing 10 which is provided on the first printed-circuit board 100 side; a movable housing 20 which is provided so as to be movable in a width direction (X direction in the figure) and in a cross direction (Y direction in the figure) with respect to the socket side fixed housing 10; a plurality of socket terminals 30 serving as a first terminal, one end of which is held by the socket side fixed housing 10, the other end of which is held by the movable housing 20, and which is formed so as to be resiliently deformed with a movement of the movable housing 20 with respect to the socket side fixed housing 10; a pair of first socket side shield members 40 serving as a first shield member, which are provided so as to cover each outer circumference surface in the width direction of the socket side fixed housing 10; a pair of second socket side shield members 50 which are provided so as to cover each outer circumference surface in the cross direction of the socket side fixed housing 10; and a pair of shield terminals 60 which are provided on an outer circumference surface in the width direction of the socket side fixed housing 10.

The socket side fixed housing 10 is made of a synthetic resin molding which has a rectangular tubular shape with the top and bottom faces opened. More specifically, the socket side fixed housing 10 consists of a front portion 11, a rear portion 12, and both side portions in width direction 13. On the bottom end side of the front portion 11 and the rear portion 12, a plurality of terminal holes 14 which holds one end of each socket terminal 30 are provided so as to be equally spaced with each other. In addition, on both sides in the direction (X direction in the figure) of arrangement of terminal holes 14, a pair of shield terminal holes 15 which hold each shield terminal are provided. On the both sides in width direction of the front portion 11 and the rear portion 12, a mounting groove 16 for mounting each of the first socket side shield members 40 from above is formed.

The movable housing 20 is made of a synthetic resin molding which has a box shape with the top face opened. More specifically, the movable housing 20 consists of a front portion 21, a rear portion 22, both side portions in width direction 23, and a bottom portion 24. On the center of the bottom portion 24, a mating portion 25 which is formed so as to protrude upward is provided. In addition, on the side wall portions at the front side and the rear side of the mating portion 25, a plurality of terminal holes 26 which hold the other end of each socket terminal 30 are formed so as to pass through the bottom portion 24 in an up/down direction (Z direction in the figure). Further, on the font/rear direction both sides of the bottom portion 24, a pair of insertion through holes 27 which are formed so as to be able to insert the other end side of each of the shield terminals 60 in the up/down direction are provided so as to be placed on the arrangement direction both sides of each of the socket terminals 30.

Each of the socket terminals 30 is made of a conductive metal plate capable of being resiliently deformed, and is provided in line on the both sides in front/rear direction of the socket 1. As shown in FIG. 3, the socket terminal 30 is formed such that a connection portion 31 to be connected to the first printed-circuit board 100 extends in the front/rear direction. In addition, the socket terminal 30 is provided with a first upstanding portion 32 which extends upward from the rear end of the connection portion 31; a bending portion 33 which bends downward from the top end of the first upstanding portion 32; a second upstanding portion 34 which extends obliquely downward from the bending portion 33; a third upstanding portion 35 which extends rearward from the bottom end of the second upstanding portion 34; a fourth upstanding portion 36 which extends upward from the rear end of the third upstanding portion 35; and a contact portion 37 which extends upward while bending forward from the fourth upstanding portion 36. The socket terminal 30 is formed so as to be resiliently deformed in the width direction and in the front/rear direction starting at the bending portion 33.

Each of the first socket side shield members 40 is made of a conductive metal plate which extends in the width direction of the socket side fixed housing 10, and is mounted so as to cover the outer circumference surface in the width direction of the socket side fixed housing 10 by press-inserting the both sides in width direction of the shield members 40 into each of the mounting grooves 16 of the socket side fixed housing 10 from above. In addition, each of the first socket side shield members 40 is formed into an approximately L shape such that the top end side covers the top surface of the front portion 11 or the rear portion 12 of the socket side fixed housing 10 and extends to the front portion 21 or the rear portion 22 of the movable housing 20.

Each of the second socket side shield members 50 is made of a conductive metal plate, like each of the first socket side shield members 40, and is formed so as to cover the outer circumference surface in the front/rear direction of the socket side fixed housing 10. In addition, each of the both sides in front/rear direction of the second socket side shield members 50 bends in the width direction to be in contact with each of the first socket side shield members 40.

Each of the shield terminals 60 is made of a conductive metal plate capable of being resiliently deformed. As shown in FIG. 4, a ground connection portion 61 capable of connecting to a ground portion (not shown) provided on the first printed-circuit board 100 is formed so as to extend in the front/rear direction. In addition, each of the shield terminals 60 is provided with a first upstanding portion 62 which extends upward from the rear end of the ground connection portion 61. Each of the both sides in width direction of the first upstanding portion 62 is provided with a second upstanding portion 63 which extends forward from the first upstanding portion 62. Further, the front end of each of the second upstanding portion 63 is provided integrally with a first shield conductive portion 64 which is in contact with the first socket side shield member 40. Further, each of the shield terminals 60 is provided with a first bending portion 65 which bends downward from the top end of the first upstanding portion 62; a third upstanding portion 66 which extends obliquely downward from the first bending portion 65; a second bending portion 67 which bends upward from the bottom end of the third upstanding portion 66; and a fourth upstanding portion 68 which extends obliquely upward from the second bending portion 67. Each of the shield terminals 60 is formed so as to be resiliently deformed in the width direction and in the front/rear direction starting at the first and second bending portions 65 and 67. In addition, the top end of the fourth upstanding portion 68 is provided integrally with a second shield conductive portion 69 which is in contact with a plug side shield member 90 described later.

Here, when each of the socket terminals 30 is mounted to the socket side fixed housing 10, the socket terminal 30 is press-inserted into the terminal hole 14 from below. At this time, as shown in FIG. 5, one end side of the socket terminal 30, i.e., the top end side of the connection portion 31 is held by the terminal hole 14. In addition, when the movable housing 20 is press-inserted to the other end side of each of the socket terminals 30 from above, the fourth upstanding portion 36 and the contact portion 37 of each of the socket terminals 30 are held by the terminal hole 26 by passing through the bottom portion 24 of the movable housing 20.

In addition, when the shield terminal 60 is mounted to the socket 1, the shield terminal 60 is press-inserted into the shield terminal hole 15 from below. At this time, the top end side of the ground connection portion 61 and the top end side of each second upstanding portion 63 are held by the shield terminal hole 15. In addition, the shield terminal 60 is held in a state where the fourth upstanding portion 68 and the second shield conductive portion 69 pass upward through the insertion through hole 27 of the movable housing 20. In this case, each of the outer circumference surfaces in the width direction and in the front/rear direction of the socket side fixed housing 10 is covered with each of the shield members 40 and 50, and thus, it is possible to reduce the effect of electromagnetic waves from outside on each of the socket terminals 30. In addition, the first and second shield conductive portions 64 and 69 of the shield terminal 60 are provided on both sides in the direction of arrangement of the socket terminals 30, and thus it is possible to reliably prevent the resilient deformation of the socket terminal 30 from blocking by the shield contact portions 64 and 69.

Next, the configuration of the plug 2 will be described. As shown in FIGS. 6 and 7, the plug 2 is provided with a plug side fixed housing 70 serving as a second housing provided on the second printed-circuit board 200 side; a plurality of plug terminals 80 each serving as a second terminal which is formed so as to be held by the plug side fixed housing 70; and a pair of plug side shield members 90 each serving as a second shield member provided so as to cover an outer circumference surface in the width direction of the plug side fixed housing 70.

The plug side fixed housing 70 is made of a synthetic resin molding which has a box shape with the top face opened. More specifically, the plug side fixed housing 70 consists of a front portion 71, a rear portion 72, both side portions in width direction 73, and a bottom portion 74. The plug side fixed housing 70 is provided so as to be movable with respect to the socket side fixed housing 10 of the socket 1, and is formed so as to be matable with the movable housing 20. On the bottom side and the inner wall portion of each of the front portion 71 and the rear portion 72 of the plug side fixed housing 70, a plurality of terminal holes 75 which hold each of the plug terminals 80 are provided so as to be equally spaced with each other. On the top end side of each of the front portion 71 and the rear portion 72, a mounting groove 76 for mounting the plug side shield member 90 is formed.

Each of the plug terminals 80 is made of a conductive metal plate and is provided in line on the both sides in front/rear direction of the plug 2. As shown in FIG. 8, the plug terminal 80 is formed such that a connection portion 81 to be connected to the second printed-circuit board 200 extends in the front/rear direction. One end side of the connection portion 81 is provided with a contact portion 82 which extends upward.

Each of the plug side shield members 90 is made of a conductive metal plate which extends in the width direction of the plug side fixed housing 70, and is mounted so as to cover the outer circumference surface in the width direction of the plug side fixed housing 70 by press-inserting the top end into the mounting grooves 76 of the plug side fixed housing 70 from below. In addition, the bottom end of the both sides in width direction of each of the plug side shield members 90 is provided with a ground connection portion 91 which can be connected to a ground portion (not shown) provided on the second printed-circuit board 200 and which is formed so as to extend in the front/rear direction.

Here, when each of the plug terminals 80 is mounted on the plug side fixed housing 70, the plug terminal 80 is press-inserted into the terminal hole 75 from below. At this time, as shown in FIG. 8, the connection portion 81 and the contact portion 82 of the plug terminal 80 are held by the terminal hole 75 of the plug side fixed housing 70. In this case, the plug side shield member 90 covers the plug side fixed housing 70 in the width direction of the housing. That is to say, the plug side shield member 90 covers the outer circumference surfaces of the front portion 71 and the rear portion 72. Therefore, it is possible to reduce the effect of electromagnetic waves from outside on each of the plug terminals 80.

Figure 9:
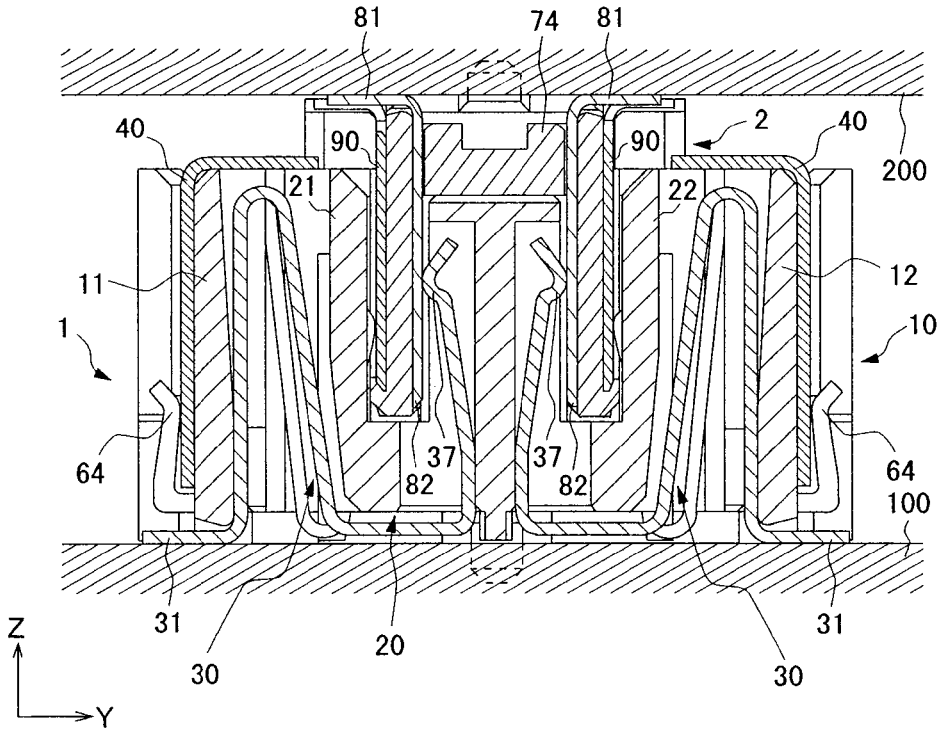
FIG. 9 is a side sectional view of an operation when the socket is mated with the plug.
Figure 10:
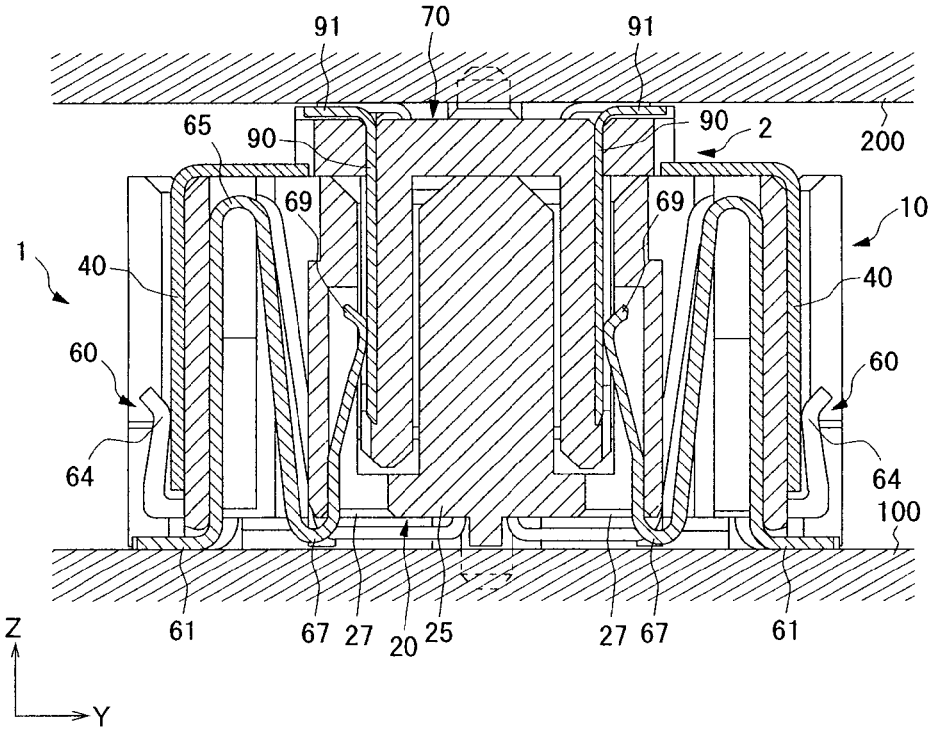
FIG. 10 is a side sectional view of an operation when the socket is mated with the plug.

The connector configured as above is used to electrically connect a pair of printed-circuit board 100 and 200. As shown in FIG. 9, in the case where the plug 2 connected to the second printed-circuit board 200 is provided above the socket 1 connected to the first printed-circuit board 100, when the plug 2 is moved downward and the plug side fixed housing 70 is mated with the mating portion 25 of the movable housing of the socket 1, the contact portion 82 of each of the plug terminals 80 is in contact with the contact portion 37 of each of the socket terminals 30. In this case, as shown in FIG. 10, a first shield conductive portion 64 of the shield terminal 60 is in contact with the first socket side shield member 40 and a second shield conductive portion 69 is in contact with the plug side shield member 90. Here, when one of the socket side fixed housing 10 and the plug side fixed housing 70 is moved with respect to the other in the width direction and in the front/rear direction, the socket terminal 30 and the shield terminal 60 are resiliently deformed with the above movement, and a relative positional offset of each of the fixed housings 10 and 70 is absorbed.

Accordingly, according to the present embodiment, it is possible to move the plug 2 with respect to the socket 1 since the connector comprising a socket 1 arranged on a first printed-circuit board 100; a plug 2 arranged on a second printed-circuit board 200, is provided so as to be movable with respect to the socket 1, and is formed so as to be matable with the socket 1; a plurality of socket terminals 30 which are held by the socket 1, and which are formed so as to be resiliently deformed with a movement of the plug 2; a pair of first socket side shield members 40 which are provided so as to cover the outer circumference surface in the width direction of the socket 1 and are formed so as to extend in the direction of arrangement of the socket terminals 30; a plurality of plug terminals 80 which are held by the plug 2 and are formed so as to be in contact with each of the socket terminals 30 when the plug 2 is mated with the socket 1; a plug side shield member 90 which is provided so as to cover an outer circumference surface in the width direction of the plug 2 and is formed so as to extend in the direction of arrangement of the plug terminals 80; and first and second shield conductive portions 64 and 69 which are formed such that when the plug 2 is mated with the socket 1, the shield conductive portions are in contact with each of the shield members 40 and 90 and are resiliently deformed as the plug 2 is moved. Therefore, when a positional offset occurs between the first printed-circuit board 100 and the second printed-circuit board 200, the positional offset can be absorbed and thus it is possible to increase the reliability of connection. In addition, since an EMI measure for the socket 1 and the plug 2 can be taken, it is possible to reliably reduce the effect of electromagnetic waves.

In addition, the shield contact portions 64 and 69 are provided on at least one end side in the direction of arrangement of each of the terminals 30 and 80, and thus it is possible to reliably prevent the resilient deformation of the socket terminal 30 due to a movement of the plug 2 from blocking by the shield contact portions 64 and 69.

Further, the socket 1 is provided with a shield terminal 60 which is provided integrally with a first shield conductive portion 64 which is in contact with a first socket side shield member 40; and a second shield conductive portion 69 which is in contact with a plug side shield member 90. Therefore, it is possible to reduce the number of components and it is beneficial in terms of manufacturing costs.

In addition, the shield terminal 60 is provided with a ground connection portion 61 capable of connecting to a ground portion of the first printed-circuit board 100. Therefore, a member for connecting to the ground portion need not be provided on the first socket side shield member 40. Accordingly, it is possible to increase the flexibility of designing the first socket side shield member 40.

It should be noted that the above embodiment is just an example and the present invention is not limited to the above embodiment. For example, according to the above embodiment, the shield terminal 60 is provided on the socket 1, but the shield terminal 60 may be provided on the plug 2.

What is claimed is:

1. An electrical connector comprising:

a first housing on a side of one object to be connected;

a second housing on a side of another object to be connected, the second housing being movable with respect to the first housing and matable with the first housing;

a plurality of first terminals which are held by the first housing and are resiliently deformable with movement of the second housing;

a first shield member for covering a predetermined outer circumference surface of the first housing and extending in the direction of arrangement of the first terminals;

a plurality of second terminals which are held by the second housing, the second terminals being arranged to contact each of the first terminals while the second housing is mated with the first housing;

a second shield member for covering a predetermined outer circumference surface of the second housing and extending in the direction of arrangement of the second terminals; and first and second shield conductive portions for electrically connecting the first and second shield members while the second housing is mated with the first housing and resiliently deformable with movement of the second housing, a shield terminal on one of said first and second housings, the shield terminal being integral with the first shield conductive portion in electrical contact with the first shield member and the second shield conductive portion in electric contact with the second shield member, the second shield conductive portion being arranged to electrically and physically contact a mating part of the second shield member of the second housing while the second housing is mated with the first housing, the second shield member being mateable with the first housing.

2. The connector according to claim 1, wherein at least one of said shield conductive portion is on at least one end side in the direction of arrangement of the terminals.

3. The connector according to claim 1, wherein said shield terminal has a ground connection portion for electrical connecting to an external ground portion.

4. An electrical connector arrangement comprising a socket and plug, the socket and plug each having resilient terminals with portions arranged to electrically and physically mate with each other while the socket and plug are mated, the socket including a first shield arrangement covering outer surfaces of said portions of the socket including the socket terminals that are arranged to electrically and physically mate with the plug terminals, the plug including a second shield arrangement covering at least some outer surfaces of said portions of the plug including the plug terminals that are arranged to electrically and physically mate with the socket terminals, the first and second shield arrangements including shield terminals for electrically connecting the first and second shield arrangements to each other while the socket and plug are mated, the socket shield terminal being resilient and including first and second connection segments for respectively contacting portions of the first and second shield arrangements while the socket and plug are mated.

5. The connector of claim 4 wherein the terminals of the socket and plug include further portions for physically and electrically mating with exterior surfaces of first and second opposed printed circuit boards, at least some of the further portions extending outside outer surfaces of the socket and plug and the first and second shield arrangements.

6. The connector of claim 5 wherein the first and second segments are arranged to: (a) extend in the same direction away from said exterior surface of the first printed circuit board while the socket and plug are mated, and while the socket and plug are mated with the first and second printed circuit boards, respectively, and (b) be physically biased away from the first and second shield arrangements by contact with the first and second shield arrangements, the physical bias being in the same direction that is parallel to the exterior surface of the first printed circuit board.

* * * * *